US006158675A

United States Patent [19]

Ogi

[11] Patent Number: 6,158,675

[45] Date of Patent: Dec. 12, 2000

[54] SPRINKLER SPRAY HEAD

[75] Inventor: Jeffrey M. Ogi, Rancho Cucamonga, Calif.

[73] Assignee: Anthony Manufacturing Corporation Residential Products Division, Azusa, Calif.

[21] Appl. No.: 09/401,428

[22] Filed: Sep. 22, 1999

[51] Int. Cl.[7] ..... B05B 1/16; B05B 1/26

[52] U.S. Cl. ..... 239/396; 239/443; 239/504; 239/505; 239/518; 239/DIG. 1

[58] Field of Search ..... 239/71, 74, 390, 239/396, 436, 443, 444, 498, 504, 505, 518, 520–522, DIG. 1, 580, 465

[56] References Cited

U.S. PATENT DOCUMENTS

| | | | |
|---|---|---|---|
| 3,762,650 | 10/1973 | Radecki | 239/396 |
| 4,189,099 | 2/1980 | Bruninga . | |
| 4,220,283 | 9/1980 | Citron | 239/518 X |
| 4,625,917 | 12/1986 | Torney | 239/444 X |
| 4,739,934 | 4/1988 | Gewelber . | |
| 5,050,800 | 9/1991 | Lamar | 239/444 X |
| 5,642,861 | 7/1997 | Ogi et al. . | |

*Primary Examiner*—Lesley D. Morris
*Attorney, Agent, or Firm*—Kelly Bauersfeld Lowry & Kelley LLP.

[57] ABSTRACT

An improved sprinkler spray head is provided for delivering irrigation water to surrounding vegetation, wherein the spray head delivers the irrigation water in the form of one or more discrete streams of selected pattern over a broad range of water supply pressures and substantially without undesirable pattern distortion such as atomization or fogging. The spray head comprises an upper deflector plate mounted on a base ring which is adapted in turn for mounting onto the upper end of a water supply riser. The deflector plate and base ring cooperatively define multiple internal flow paths each including a selectively opened flow port for water flow from the riser to an associated one of a plurality of spray nozzles. Each internal flow path defines a relatively narrow metering orifice for metered flow of water to an elongated flow channel open at one side to a relatively large plenum chamber, with an upper or downstream end of the flow channel being coupled to the associated spray nozzle which delivers the water flow outwardly in a selected pattern over the surrounding terrain substantially without spray pattern distortion over a relatively broad range of low to high water supply pressures.

19 Claims, 4 Drawing Sheets

SPRINKLER SPRAY HEAD

BACKGROUND OF THE INVENTION

This invention relates generally to irrigation sprinkler devices of the type having a spray head defining one or more spray nozzles through which irrigation water is delivered in a selected pattern of distribution to surrounding vegetation. More particularly, this invention relates to an improved irrigation spray head which substantially resists spray pattern distortion such as atomization, misting or fogging in response to a relatively high water supply pressure.

Sprinkler spray heads are well known in the art, of the type adapted for mounting onto the upper end of a fixed or pop-up water supply riser and including one or more spray nozzles shaped to distribute irrigation water in a selected pattern to surrounding vegetation such as turf grass, shrubs and the like. In one common form, such spray heads are manufactured from relatively economical plastic to include an upper deflector plate assembled with a lower base ring for mounting onto a water supply riser, wherein the deflector plate and base ring cooperatively define one or more contoured spray nozzles through which water stream sprays are projected outwardly in a discrete pattern or patterns. A throttling screw is typically provided for variably adjusting the water flow rate and distance of throw. Such spray nozzle or nozzles may be configured to provide a quarter-circle, half-circle, three-fourths-circle, or full-circle spray pattern. Alternately, the spray nozzle or nozzles may be shaped to distribute irrigation water in one direction along a narrow strip, or in opposite directions along narrows strips. In some spray head designs, multiple flow ports in the spray head may be provided in an initially closed condition and adapted to be opened as desired to provide a customized spray pattern from a standard or generic spray head. Desirably, such multi-ported spray head is designed further to provide a substantially uniform precipitation rate over surrounding terrain, regardless of the specific pattern selected. For examples of sprinkler spray heads of this general type, see U.S. Pat. Nos. 4,189,099; 4,739,934; and 5,642,861.

These sprinkler spray heads provide satisfactory irrigation of a surrounding terrain area, with relatively uniform precipitation rates, when the water supplied to the spray head is at a pressure within a relatively narrow design pressure range, typically on the order of about 15–30 psi. However, when the water supply pressure varies from the design pressure range, inconsistencies and instabilities in the projected irrigation stream spray or sprays can and do occur. More specifically, as the water supply pressure increases, there is an increased tendency for the projected irrigation stream spray pattern to become distorted particularly due to atomization upon discharge passage through the spray nozzle. Significant atomization results in conversion of the projected water from a discrete stream spray of a known pattern shape to a mist or fog which can be haphazardly wind-blown or otherwise vaporize. As a result, the irrigation water does not reach the surrounding terrain in the desired precipitation pattern.

In a typical irrigation system, the water supply pressure can fluctuate significantly. For example, terrain elevation variations in a municipal water supply system can produce localized relatively high pressure regions wherein the water supply pressure can range from 40 psi to as high as 100 psi. Such relatively high water supply pressures unfortunately result in the operation of many sprinkler spray heads in many irrigation systems at water pressures greater than their intended design pressure range, creating significant spray pattern distortion to correspondingly reduce the effectiveness and efficiency of water delivery to vegetation.

The present invention is directed to an improved sprinkler spray head designed to provide consistent and predictable delivery of irrigation water to surrounding vegetation, substantially without misting or fogging in response to a relatively broad range of low to high water supply pressures.

SUMMARY OF THE INVENTION

In accordance with the invention, an improved sprinkler spray head is provided for delivering irrigation water to surrounding vegetation, wherein the spray head delivers the irrigation water in the form of a discrete stream spray or sprays of selected pattern over a broad range of relatively low to high water supply pressures and substantially without undesirable pattern distortion such as atomization or fogging. The improved spray head defines at least one internal flow path to include a relatively narrow metering orifice for metered flow of water to an elongated and open-sided flow channel, with an upper or downstream end of the flow channel being coupled to an associated spray nozzle which delivers the water flow outwardly in the selected spray pattern.

In a preferred form, the improved spray head comprises an upper deflector plate mounted on a base ring which is adapted in turn for mounting onto the upper end of a water supply riser. The deflector plate and base ring cooperatively define multiple internal flow paths each including a generally tubular and selectively opened flow port for water flow from the riser to an associated one of a plurality of spray nozzles. From the flow port, each internal flow path includes the relatively narrow metering orifice leading to the elongated flow channel which opens at one side into a plenum chamber of relatively large cross sectional area. Water passing through the metering orifice tends to flow with a jet action within the open-sided flow channel to the associated spray nozzle for outward projection from the spray head in the form of a discrete water stream spray having a selected pattern configuration in accordance with the spray nozzle geometry. The combination of the metering orifice and the open-sided flow channel with adjoining plenum chamber is believed to result in converting a significant portion of the dynamic flow energy to static pressure prior to discharge flow through the associated spray nozzle, resulting in a controlled and pattern-consistent projected water stream spray when the water supply pressure is relatively high.

The spray head comprises a standard or generic spray head having the multiple internal flow paths communicating respectively with the individual spray nozzles, wherein one of the flow ports may be initially open and the remaining flow ports are initially closed by rupturable seal membranes. These seal membranes are carried on the base ring and are exposed at the underside thereof for access prior to installation of the sprinkler head onto the water supply riser. A pointed tip tool is provided for piercing and opening a selected one or more of the seal membranes to permit water flow through the associated flow tubes and further through the related internal flow paths during sprinkler operation. Accordingly, the specific number of spray nozzles supplied with water during sprinkler operation, and thus the specific overall pattern of water distribution from one or more spray head nozzles, may be custom-selected by opening selected ones of the seal membranes.

Other features and advantages of the invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
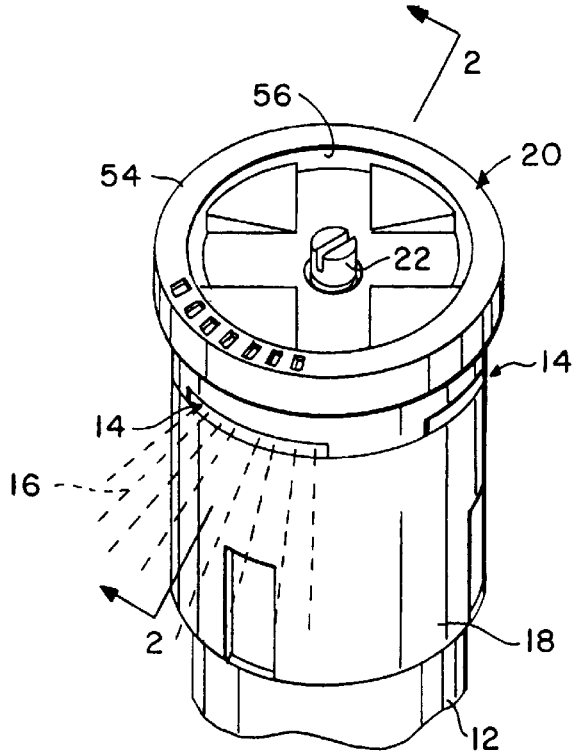
FIG. 1 is a perspective view of a sprinkler spray head embodying the novel features of the invention, and shown mounted at the upper end of a water supply riser in an irrigation system for supplying a stream spray of irrigation water substantially in a quarter circle pattern.

As shown in the exemplary drawings, an improved sprinkler spray head referred to generally in FIG. 1 by the reference numeral 10 is provided for mounting onto the upper end of a tubular water supply pipe or riser 12. The spray head 10 includes a plurality of spray nozzles 14, one or more of which is selectively coupled to water under pressure supplied via the riser 12 to project one or more water stream sprays 16 outwardly from the spray head 10 in a predetermined spray pattern to irrigate vegetation such as turf grass, shrubs and the like within a terrain area covered by the spray pattern. In accordance with the invention, the improved spray head 10 is designed to deliver the water stream spray or sprays 16 over a broad range of water supply pressures substantially without significant atomization thereof, to reduce or eliminate misting or fogging and related spray pattern distortion particularly when the water supply pressure is relatively high.

The sprinkler spray head 10 comprises a generally cylindrical body including a lower base ring 18 adapted for assembly with an upper deflector plate 20 (FIGS. 2 and 3), wherein these components can be formed conveniently and economically from lightweight molded plastic. The assembled base ring 18 and deflector plate 20 cooperatively define a plurality of contoured internal flow paths for water flow from the riser 12 respectively to each of the multiple spray nozzles 14 to irrigate the surrounding terrain area. A throttling screw 22 is carried by the assembled base ring 18 and deflector plate 20 for adjustably setting the position of a throttling head 24 relative to an inlet port 26 formed in a conventional rock screen 28, to selectively regulate the water flow rate to and through the spray head 10. Importantly, the geometry of each contoured internal flow path through the spray head 10 is designed to prevent significant distortion in or disruption of the spray pattern of the projected water stream spray or sprays 16, particularly when the water is supplied to the spray head at a relatively high supply pressure, e.g., 40–100 psi.

More specifically, the base ring 18 has a generally cylindrical shape to include an internally threaded lower end 30 for thread-on mounting onto an externally threaded upper end of the riser 12 (FIG. 2), which can be a stationary riser or a pop-up riser of the type adapted for mounting into a pop-up sprinkler unit (not shown). The rock screen 28 includes a tubular central perforated filter element 32 suspended from a radially outwardly extending and imperforate upper flange 34 having its perimeter captured between the upper end of the riser 12 and an internal stepped shoulder 36 formed in the base ring 18. The upper flange 34 of the rock screen 28 defines the open inlet port 26 for water flow from the riser 12 to the spray head 10. A central divider wall 38 is formed within the base ring 18 and supports an upstanding central boss 40 (FIGS. 2–5) which is internally threaded for threadably receiving the throttling screw 22. As shown (FIGS. 2 and 5), the deflector plate 20 has a central aperture 42 formed therein for upwardly exposing a slotted upper end 44 of the throttling screw 22, to permit rotational adjustment of the throttling screw 22 to translate the throttling head 24 thereon toward or away from the underlying inlet port 26 to regulate water flow to the sprinkler head in a manner known to persons skilled in the art.

Figure 2:
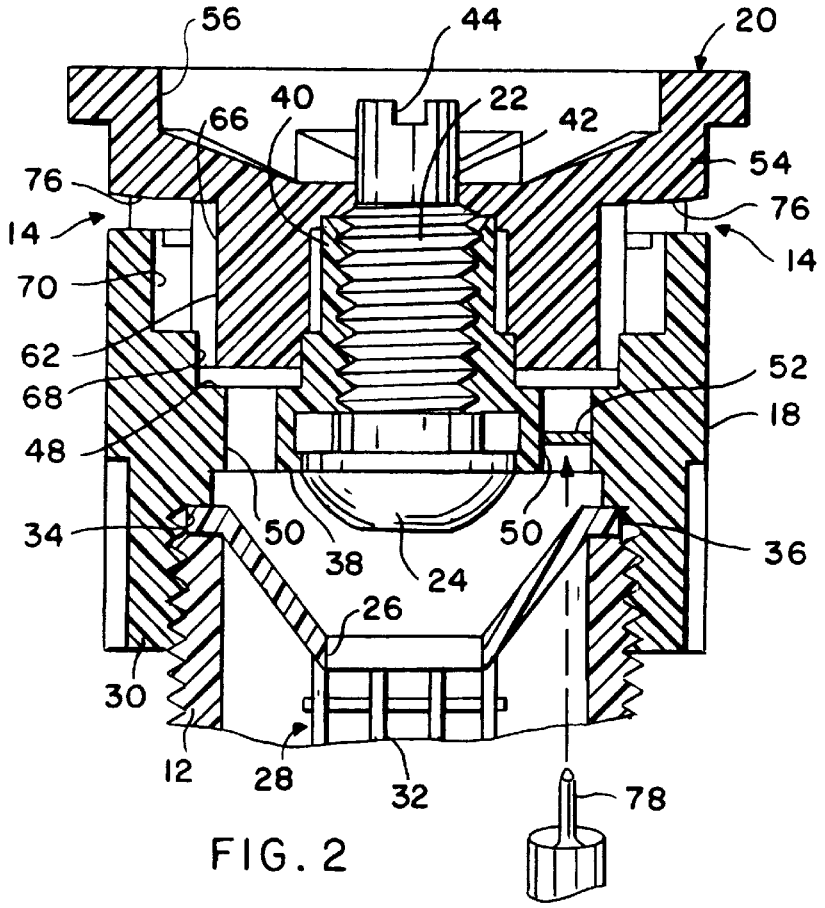
FIG. 2 is an enlarged fragmented vertical sectional view taken generally on the line 2—2 of FIG. 1.
Figure 4:
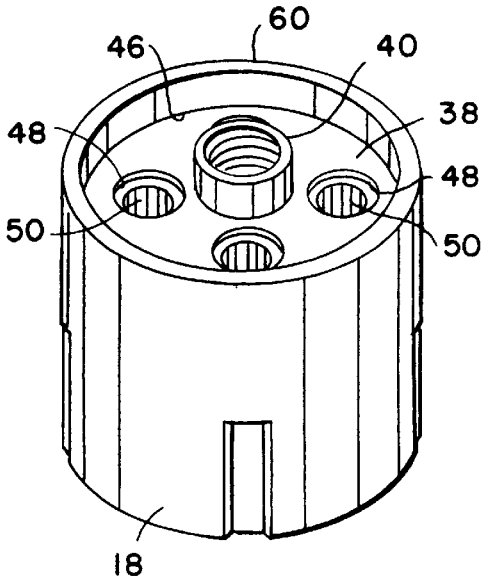
FIG. 4 is a top perspective view of the base ring depicted in FIG. 3.
Figure 5:
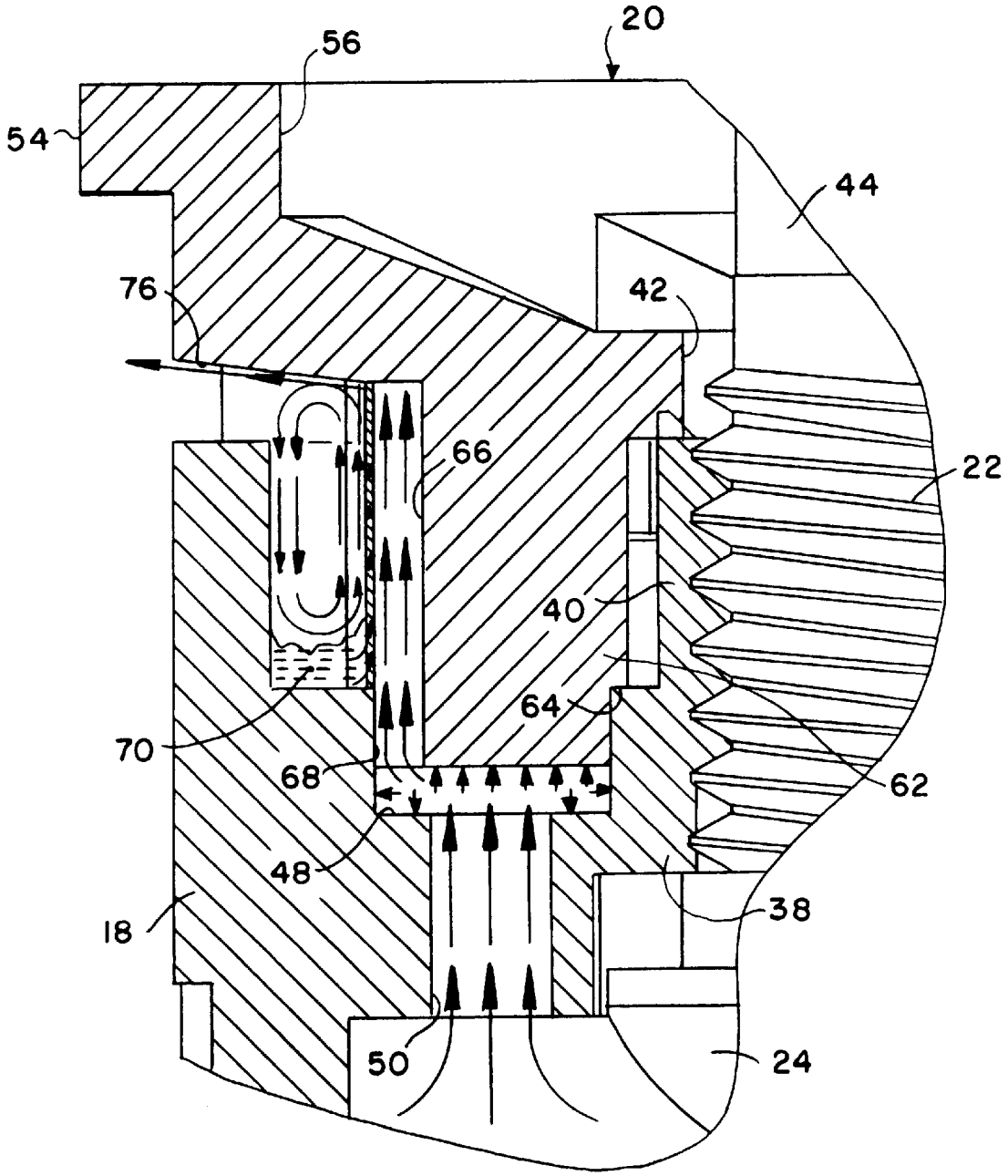
FIG. 5 is an enlarged fragmented vertical sectional view similar to a portion of FIG. 2, and illustrating water flow through an internal flow path formed within the improved spray head.

An upper side of the base ring 18 defines an annular cavity 46 surrounding the central boss 40 at the upper side of the divider wall 38, as shown in FIG. 4. At the floor of this annular cavity 46, a plurality of cylindrical counterbores 48 are formed to extend partially into the divider wall 38. The lower ends of these counterbores 48 are each coupled in turn with an associated one of a plurality of elongated and comparatively smaller diameter flow tubes 50 having lower ends which are open at the underside of the divider wall 38 to incoming water flow from the riser 12 (FIGS. 2, 4 and 5). As shown in the illustrative drawings in accordance with a preferred form of the invention, a total of four flow tubes 50 and a corresponding number of four counterbores 48 are formed in the divider wall 38 at uniformly spaced 90° intervals about the central boss 40. Moreover, in the preferred form, one of the flow tubes 50 is initially provided in an open state to define an open flow port permitting water flow therethrough, whereas the remaining three flow tubes are initially closed by a piercable or rupturable seal membrane 52 (FIG. 2).

The upper deflector plate 20 comprises a generally circular upper disk 54 having a shallow depression 56 formed in an upper side thereof, within which the slotted upper end 44 of the throttling screw 22 is exposed through the central aperture 42. A lower peripheral margin of the disk 54 defines a generally annular and downwardly presented shoulder 58 (FIG. 3) for seated reception upon an annular upper end 60 of the base ring 18. The deflector plate 20 is securely attached to the base ring 18, as by an adhesive or sonic weld connection between the shoulder 58 and the base ring upper end 60.

A plurality of metering pins 62 are formed on the deflector plate 20 to project downwardly from the upper disk 54 for individual slide-fit reception into the counterbores 48 in the base ring 18. As shown, these metering pins 62 are substantially identical in construction and have stepped lower ends (shown best in FIG. 3) defining annular shoulders 64 which seat on and are desirably butt-welded to the divider wall 38 at the upper ends of the counterbores 48, when the deflector plate shoulder 58 is seated on the annular upper end 60 of the base ring 18. From the annular shoulders 64, the lower ends of the metering pins 62 protrude downwardly to fit closely and slidably into the counterbores 48, each terminating at a lower or distal pin end spaced slightly above the bottom of the associated counterbore (FIGS. 2 and 5) to define a shallow chamber at the bottom of the counterbore 48 having a cross sectional size greater than the underlying flow tube 50. A radially outwardly presented surface of each metering pin 62 is interrupted by a shallow and elongated, substantially linear groove or flow channel 66 which extends vertically and longitudinally from the lower pin end without interruption to an associated one of the spray nozzles 14 formed at the underside of the upper disk 54.

Figure 3:
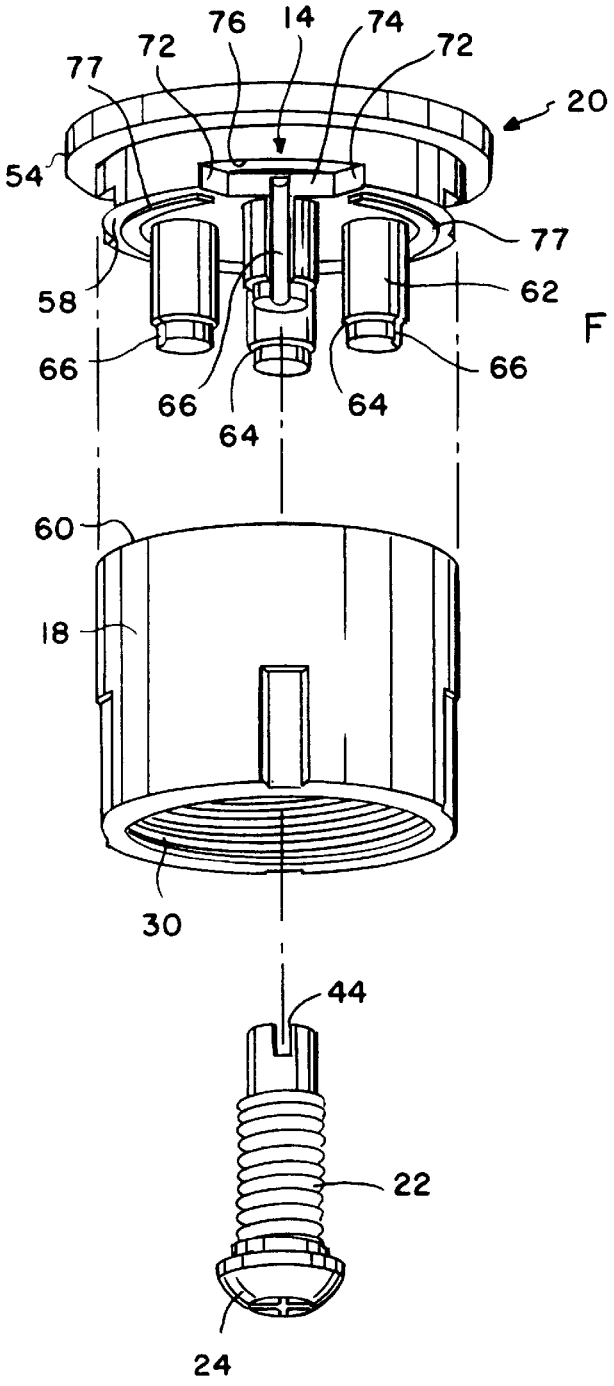
FIG. 3 is an exploded bottom perspective view of a deflector plate, base ring, and throttling screw components of the spray head of FIG. 1.

As shown best in FIGS. 2, 3 and 5, the flow channel 66 formed in each metering pin 62 has a groove depth sufficient to penetrate a short distance into the reduced diameter lower end of the metering pin. Accordingly, the flow channel 66 cooperates with the cylindrical wall of the associated counterbore 48 in the base ring divider wall 38 to define a metering orifice 68 (FIGS. 2 and 5) of relatively narrow cross section communicating with the underlying unoccupied portion of the counterbore 48 and the underlying associated flow tube 50, and also with an upper portion of the flow channel 66 disposed above the counterbore 48 (FIGS. 2 and 5). Importantly, this upper portion of the flow channel 66 is radially outwardly open and is thus exposed at one side to an annular plenum chamber 70 (FIGS. 2 and 5) defined by the upper cavity 46 in the base ring 18. This plenum chamber 70 has a relatively large cross sectional size and shape, and a relatively large length in comparison to the geometry of each metering orifice 68.

The upper or downstream end of the elongated flow channel 66 formed in each metering pin 62 terminates at the associated spray nozzle 14. More particularly, as shown best in FIG. 3, each spray nozzle 14 is formed in the underside surface of the upper disk 54 and comprises a forwardly and downwardly open notched deflector in the form of a pair of side walls 72 extending radially outwardly from a rear face 74, in combination with a top deflector wall 76 which extends radially outwardly and may include a selected upward taper. The side walls 72 may diverge angularly from each other, as shown, at an appropriate angle to provide a substantially quarter-circle spray pattern. With a total of four spray nozzles 14 arranged at uniformly spaced 90° intervals as shown, and each of the spray nozzles 14 configured to provide a radially outwardly directed stream of water in a quarter-circle spray pattern, a composite full-circle spray pattern can be achieved. Alternately, it will be recognized and understood that the specific spray nozzle geometry can be varied to achieve a range of different specific spray patterns. Arcuate part-circle pads 77 may also be formed on the underside of the upper disk 54 at locations between the spaced-apart nozzles 14, to protrude a short distance into the underlying base ring cavity 46 for tailoring the stream pattern projected from each spray nozzle.

FIGS. 1 and 5 illustrate operation of the sprinkler spray head 10 with one of the flow tubes 50 open for upward water flow to the associated spray nozzle 14. As shown, the water under pressure passes upwardly through the relatively narrow flow port defined by the open flow tube 50 into a flow chamber of comparatively larger cross sectional area defined by the unoccupied lower end of the counterbore 48. The water then passes upwardly into the elongated flow channel 66 formed in the overlying metering pin 62, initially by passage through the narrow metering orifice 68. From the metering orifice 68, the water flows in the form of a jet substantially within the open-sided upper portion of the flow channel 66 to the associated spray nozzle 14, whereat the water jet is re-directed by the nozzle walls 72, 74, 76 for outward projection and dispersal from the spray head 10 in the form of a discrete water stream spray 16 of the selected spray pattern.

Figure 6:
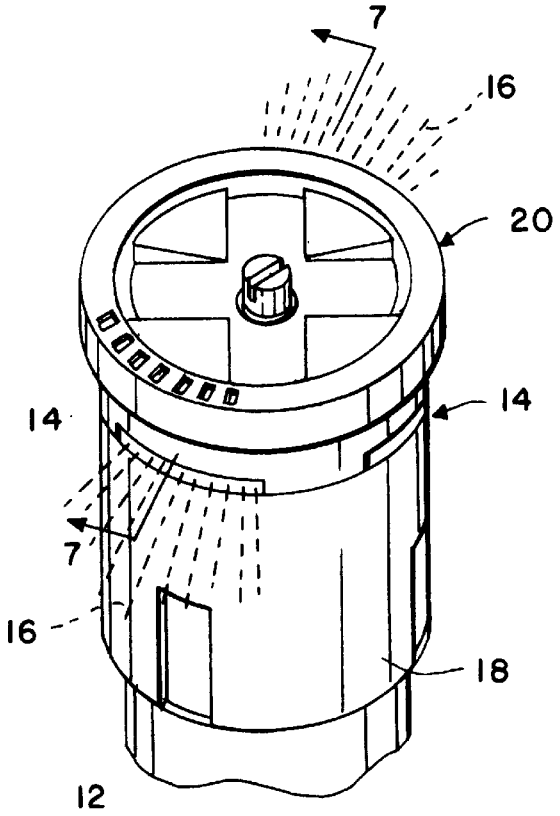
FIG. 6 is a perspective view of the sprinkler spray head similar to FIG. 1, but showing the spray head adapted for providing a pair of irrigation stream sprays substantially in quarter circle patterns and projected in opposite directions.
Figure 7:
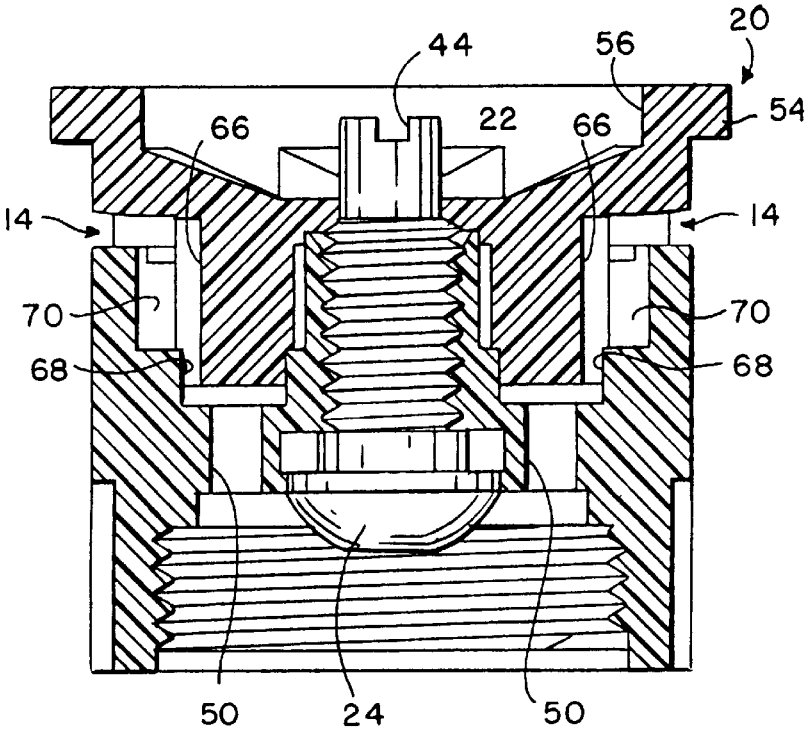
FIG. 7 is an enlarged fragmented vertical sectional view taken generally on the line 7—7 of FIG. 6.

The configuration of the flow path defined by these components, particularly to include the narrow metering orifice 68 followed by the elongated open-sided upper portion of the flow channel 66, enables the precipitation rate and spray pattern of the projected water stream 16 to remain substantially constant, without significant distortion, misting or fogging notwithstanding a relatively high water supply pressure. In this regard, it is believed that this flow path geometry enables a small volume of water to accumulate at a relatively low rate on the order of 3–10 ml/min. within the plenum chamber 70 (as depicted in FIG. 5), wherein the water jetted upwardly along the open-sided flow channel 66 passes one side of the accumulated pool with an upward shear action as illustrated by the flow arrows in FIG. 5. With this configuration, it is believed that a significant portion of the dynamic flow energy of the upwardly jetted water is converted to static pressure, with the result that a stable water stream is projected from the spray nozzle 14 in a highly uniform spray pattern, without significant misting or fogging which could otherwise distort and disrupt the spray pattern. In particular, the upward shear action is believed to cause a portion of the continuously accumulating water within the chamber 70 to be evacuated or transferred by adhering to the main flow stream, thereby carry a thin film of water upwardly from the accumulated pool, wherein this water film comprises a protectant layer through which the upwardly jetted water in the flow channel 66 must pass upon outward projection through the spray nozzle 14. As a result, it is believed that this film layer functions as an energy absorber to stabilize the water stream spray in a manner which resists or prevents significant undesired misting or fogging even when the water supply pressure is relatively high. Thus, during operation, a small amount of water is continuously accumulating within the chamber 70 and continuously being projected outwardly with the stream spray 16 to decelerate the outer layer of the main flow stream and create two velocity boundary conditions The specific terrain area irrigated by the improved spray head 10 can be custom-selected by appropriate opening of additional ones of the flow tubes 50. More particularly, one or more additional flow tubes 50 can be opened by puncturing the membranes 52 therein with a suitable pointed tip tool 78, as viewed in FIG. 2. For example, a pair of adjacent flow tubes can be open to provide projected quarter-circle water stream sprays from adjacent spray nozzles 14 to produce an overall half-circle irrigation spray pattern. Similarly, three flow tubes 50 can be open to provide a three-quarter-circle spray pattern, or all four flow tubes can be open to provide a full-circle spray pattern. As a further alternative, as viewed in FIGS. 6 and 7, a pair of opposed flow tubes 50 may be open to provide quarter-circle stream spray patterns 16 aimed in opposite directions. Accordingly, a single standard or generic style spray head 10 can be supplied at an irrigation system installation site, with each spray head being customized by opening selected ones of the flow tubes 50 to achieve a selected spray pattern in accordance with its specific location relative to the surrounding terrain. Importantly, regardless of the specific overall spray pattern selected, the spray pattern and precipitation rate associated with each discrete projected water stream 16 remains substantially constant and undistorted throughout a broad range of low to high water supply pressures, e.g., supply pressures ranging from about 15–100 psi.

A variety of further modifications and improvements in and to the improved sprinkler spray head of the present invention will be apparent to those skilled in the art. For example, the size of the metering orifice 68 defined by each flow channel 66, as well as the length of the open-sided upper portion of the flow channel 66 in relation to the metering orifice 68, can be tailored to provide the desired nozzle operating characteristics. Accordingly, no limitation on the invention is intended by way of the foregoing description and accompanying drawings, except as set forth in the appended claims.

What is claimed is:

1. A sprinkler spray head adapted to be coupled to a supply of water under pressure, comprising:

a generally cylindrical body having a first end adapted to be coupled to a supply of water under pressure, and defining at least one spray nozzle for projecting water outwardly therefrom in a selected spray pattern, and at least one internal flow path for flow of water under pressure from said first end to said spray nozzle;

said internal flow path being defined by a relatively narrow metering orifice for flow of water from said first end, and an elongated open-sided flow channel extending from said metering orifice to said spray nozzle;

said body further defining a plenum chamber of relatively large cross sectional area and a length substantially greater than said metering orifice, said elongated open-sided flow channel extending vertically through said plenum chamber in flow communication therewith.

2. The sprinkler spray head of claim 1 wherein said at least one spray nozzle defined by said cylindrical body comprises a plurality of spray nozzles each for projecting water outwardly therefrom in a selected spray pattern, and further wherein said at least one internal flow path comprises a plurality of internal flow paths each for flow of water under pressure from said first end to a respective one of said spray nozzles.

3. The sprinkler spray head of claim 2 further including rupturable means for initially closing at least one of said plurality of internal flow paths to prevent water flow therethrough.

4. The sprinkler spray head of claim 1 wherein said elongated flow channel is substantially linear in shape.

5. The sprinkler spray head of claim 1 wherein said generally cylindrical body comprises a generally cylindrical base ring having a lower end including means for coupling to a supply of water under pressure, said base ring defining at least one flow tube for passage of water therethrough, and a deflector plate mounted on an upper end of said base ring, said deflector plate including at least one metering pin having a radially open elongated groove formed therein and extending longitudinally along the length thereof, said metering pin having a lower end positioned relative to said at least one flow tube and cooperating therewith to define said metering orifice at a lower end of said groove, and whereby an upper portion of said groove defines said open-sided flow channel.

6. The sprinkler spray head of claim 5 wherein said base ring defines a plurality of said flow tubes, and said deflector plate including a plurality of said metering pins each having a lower end positioned relative to a respective one of said flow tubes to define a metering orifice, and further wherein said at least one spray nozzle comprises a plurality of spray nozzles, each of said plurality of said metering pins having said open-sided flow channel defined thereby extending upwardly to a respective one of said spray nozzles.

7. The sprinkler spray head of claim 6 further including rupturable means for initially closing at least one of said plurality of flow tubes.

8. The sprinkler spray head of claim 5 wherein said base ring defines said plenum chamber of relatively large cross sectional area in flow communication with said elongated open-sided flow channel.

9. The sprinkler spray head of claim 5 wherein said elongated flow channel is substantially linear in shape.

10. The sprinkler spray head of claim 5 wherein said base ring and said deflector plate further define a flow chamber of relatively increased cross sectional area between said flow tube and said metering orifice.

11. The sprinkler spray head of claim 1 wherein said at least one spray nozzle comprises a radially outwardly and downwardly open deflector for re-directing water flowing upwardly along said flow channel in a generally radially outward direction with a selected spray pattern.

12. The sprinkler spray head of claim 1 further including means for regulating the water flow rate to said internal flow path.

13. A sprinkler spray head adapted to be coupled to a supply of water under pressure, comprising:

a generally cylindrical body having a first end adapted to be coupled to a supply of water under pressure, and defining a plurality of circumferentially spaced spray nozzles each for projecting water outwardly therefrom in a selected spray pattern, and a corresponding plurality of internal flow paths each for flow of water under pressure from said body first end to a respective one of said spray nozzles;

each of said internal flow paths being defined by a relatively narrow metering orifice for flow of water from said body first end, and an elongated open-sided flow channel extending upwardly from said metering orifice to said respective one of said spray nozzles;

said body further defining a plenum chamber of relatively large cross sectional area and a length substantially greater than said metering orifice defined by each of said internal flow paths, said elongated open-sided flow channel defined by each of said internal flow paths extending vertically through said plenum chamber in flow communication therewith.

14. The sprinkler spray head of claim 13 further including rupturable means for initially closing at least one of said plurality of internal flow paths to prevent water flow therethrough.

15. The sprinkler spray head of claim 13 wherein said elongated flow channel defined by each of said internal flow paths is substantially linear in shape.

16. The sprinkler spray head of claim 13 wherein said generally cylindrical body comprises a generally cylindrical base ring having a lower end including means for coupling to a supply of water under pressure, said base ring defining a plurality of flow tubes for passage of water therethrough, and a deflector plate mounted on an upper end of said base ring, said deflector plate including a plurality of metering pins each having a radially open elongated groove formed therein and extending longitudinally along the length thereof, each of said metering pins having a lower end positioned relative to a respective one of said flow tubes and cooperating therewith to define said metering orifice at a lower end of said groove, and whereby an upper portion of said groove defines said open-sided flow channel.

17. The sprinkler spray head of claim 16 further including rupturable means for initially closing at least one of said plurality of flow tubes.

18. The sprinkler spray head of claim 16 wherein said base ring and said deflector plate further define a flow chamber of relatively increased cross sectional area between each of said flow tubes and the metering orifice associated therewith.

19. The sprinkler spray head of claim 13 wherein each of said spray nozzles comprises a radially outwardly and downwardly open deflector for re-directing water flowing upwardly along the associated one of said flow channels in a generally radially outward direction with a selected spray pattern.

* * * * *